US005344207A

United States Patent [19]

Grimm

[11] Patent Number: 5,344,207

[45] Date of Patent: Sep. 6, 1994

[54] TIRE LIFTING APPARATUS

[75] Inventor: Federick L. Grimm, Taylors, S.C.

[73] Assignee: Michelin Recherche et Technique S.A., Granges-Paccot, Switzerland

[21] Appl. No.: 10,826

[22] Filed: Jan. 29, 1993

[51] Int. Cl.[5] ..... B66C 1/66

[52] U.S. Cl. ..... 294/103.1; 294/67.33; 294/119.1

[58] Field of Search ..... 294/16, 103.1, 119.1, 294/67.22, 67.33, 67.5, 63.1; 414/426, 428, 429

[56] References Cited

U.S. PATENT DOCUMENTS

| | | | |
|---|---|---|---|
| 834,271 | 10/1906 | Dale | 294/119.1 X |
| 1,399,351 | 12/1921 | Lee . | |
| 1,807,360 | 5/1931 | Wehr | 294/16 X |
| 2,060,722 | 11/1936 | Breslav | 294/67.33 X |
| 2,380,313 | 7/1945 | Johnson et al. . | |
| 2,550,424 | 4/1951 | Penn | 294/103.1 |
| 2,789,716 | 4/1957 | Wolf | 294/119.1 X |
| 2,789,858 | 4/1957 | Kughler | 294/119.1 X |
| 2,792,139 | 0/1957 | Lloyd | 214/147 |
| 2,874,990 | 2/1959 | Janoff | 294/119.1 |
| 3,287,057 | 11/1966 | Gallapoo | 294/119.1 X |
| 4,232,893 | 11/1980 | Kijewski | 294/103.1 |
| 4,336,962 | 6/1982 | Read | 294/67.33 X |
| 4,596,509 | 6/1986 | Burgardt et al. | 414/426 |
| 5,064,334 | 11/1991 | Cooley | 414/428 |
| 5,098,145 | 3/1992 | Goldberg et al. | 294/119.1 |
| 5,127,695 | 7/1992 | Zoeten | 294/119.1 X |
| 5,161,347 | 11/1992 | Yakou | 294/119.1 |

FOREIGN PATENT DOCUMENTS

| | | | |
|---|---|---|---|
| 679790 | 8/1939 | Fed. Rep. of Germany | 294/103.1 |
| 1129171 | 12/1984 | U.S.S.R. | 294/67.5 |
| 1315377 | 6/1987 | U.S.S.R. | 294/67.5 |
| 1404435 | 6/1988 | U.S.S.R. | 294/119.1 |
| 1541173 | 2/1990 | U.S.S.R. | 294/67.33 |
| 1682293 | 10/1991 | U.S.S.R. | 294/119.1 |

*Primary Examiner*—Dean J. Kramer
*Attorney, Agent, or Firm*—Robert R. Reed; Alan A. Csontos

[57] ABSTRACT

An apparatus for lifting a tire comprising a pair of members. The members are supported for relative sliding movement. Throughout the relative sliding movement, respective portions of the members are maintained in an orthogonal relationship. An actuator is operably connected with each of said members for relatively moving the members from a first position, incapable of lifting the tire, to a second position, capable of lifting the tire, upon actuation.

9 Claims, 4 Drawing Sheets

TIRE LIFTING APPARATUS

BACKGROUND OF THE INVENTION

1. Technical Field

The present invention relates generally to a device for lifting articles. In particular, the present invention relates to an improved device which is particularly suitable for lifting a generally cylindrical or toroidal article, such as a tire, wheel or the like, and maintain the article throughout the lifting process in a substantially vertical orientation.

2. Description of the Prior Art

It is known that certain articles because of their shape and/or relatively heavy weight are difficult at best to move from one location to another. It is also known that when an article, such as a tire, is resting against a wall or several articles are stood vertically side by side against one another in a horizontal row, it can be difficult to partially move an article away from the wall or stack in order to grab it. It is further known in the tire industry that a tire can be difficult to handle for testing, transporting, mounting, installation or the like. This is particularly true when the tire is a large size truck tire which is mounted on a rim and inflated.

Many devices are known which assist in the handling and installation of an article, such as a tire. One such device is disclosed in U.S. Pat. No. 1,399,351. U.S. Pat. No. 1,399,351 discloses a crane type apparatus for handling a tire and rim assembly that is relatively heavy. The apparatus includes a scissors mechanism having a pair of tongs pivotable relative to a bar. Lower end portions of the tongs are movable toward and away from one another. There are a plurality of holes in the bar for receiving pins in order to change the position about which the tongs pivot. This allows the scissors mechanism to adapt to different width tire and rim assemblies. The lower ends of the tongs pivot toward one another and relative to the bar when a force is applied by a crane arm to a link which tends to slide along and move upper ends of the tongs upwardly. This pivoting of the lower ends of the tongs toward one another causes a "grabbing" action on the tire and wheel assembly.

U.S. Pat. No. 2,380,313 discloses another scissors mechanism for handling a tire. The mechanism includes a pair of tongs which are pinned together between their respective ends and are pivotable relative to one another. The lower ends of the tongs are meant to engage opposite sides of the tire or rim. One of a pair of chains is connected to a respective end of each of the tongs in order to pivot the tongs relative to one another when tension is applied to the chains. One of the chains is shorter than the other in order to offset the pivot location of the tong mechanism with respect to the tire and rim assembly.

U.S. Pat. No. 2,792,139 discloses a tire lifting device having a support surface for supporting a radially Inwardly facing portion of a rim or a tire. The apparatus also includes a tire gripping element which is reciprocally movable relative to the support surface and which can be pivotable relative to the support surface. The tire gripping element acts to retain the tire from separating from the support surface. The tire gripping element can be pivoted and reciprocated by various means.

U.S. Pat. No. 4,596,506 discloses a wheel lifting device having an adjustable grasping mechanism for accommodating various sized tires. The grasping mechanism retains the tire from falling over when movable chocks lift the tire. The grasping mechanism may be adjusted through an arrangement of four fasteners which extend through four slots, respectively, in a gusset to permit movement between members. However, these members are not easily adjustable and are not automatically moved upon actuation of the wheel lifting mechanism.

U.S. Pat. No. 5,064,334 discloses a wheel clamp having a scissors mechanism in which tongs are pivotable relative to one another and support radially inward facing surfaces of a rim or a tire. The tongs are relatively pivotable relative to one another and are actuated by tensioning a chain attached to the tongs. A second embodiment includes a member for supporting a side of the tire when the radially inward facing surface of the tire is supported by another member. The two members are relatively movable to one another in one direction only. Again, however, the members in this second embodiment do not automatically move to clamp the tire upon actuation of the mechanism.

SUMMARY OF THE INVENTION

The present invention is directed to an apparatus for lifting an article and which apparatus is relatively light in weight, has a relatively large load carrying capacity and once it is spanning the tire is adjustable to support any height or width of a tire automatically upon actuation. The apparatus of the present invention is for lifting a cylindrically or toroidally shaped article such as a tire, rim assembly thereof, or the like. The apparatus includes a pair of members. The members are supported for reciprocal and relative sliding movement. During such relative sliding movement, portions of the members are maintained in an orthogonal relationship. Actuatable means is operably connected with each of the members. The actuatable means moves the members from a first position incapable of lifting the article to a second position capable of lifting the article upon actuation.

The apparatus also includes, within the actuatable means, means for preventing movement from the second position towards the first position during actuation. A first one of the members includes at least one finger for engaging a portion of the tire which is disposed vertically. A second one of the members Includes a support for engaging a portion of the article which is disposed horizontally. Friction enhancement means is included on a surface of the finger that is engagable with the portion of the article.

The first member comprises an elongate first bar having an effective length which is greater by a predetermined amount than the largest width of article anticipated to be lifted. The finger is attached to one end of the first bar. The finger has a portion extending from the location of attachment to the first bar in a direction on the side of the finger on which the first bar is located. The second member includes an elongate second bar and a shaft extending transversely from the bar. The second bar has an effective length which is greater by a predetermined amount than the largest height of the article that is anticipated to be lifted.

A clamp having a pair of channels defined therein supports the members and maintains them in the orthogonal relationship during the sliding movement between the members. The actuatable means comprises a linkage having a coupler and a pair of legs. Each of the legs is operably connected at one end with the coupler and at another end with a respective one of the members. A first one of the legs has a length greater than the length of a second one of the legs for moving the members towards the second position upon actuation of the actuatable means. Preferably, the legs comprise a chain and the coupler comprises a pear shape link larger in size than any link In the chains. Actuation of the actuatable means is defined to mean subjecting each of the legs to a tensile force.

BRIEF DESCRIPTION OF THE DRAWINGS

Further features of the present Invention will become apparent to those skilled in the art to which the present invention relates from reading the following specification with reference to the accompanying drawings, in which.

DESCRIPTION OF PREFERRED EMBODIMENTS

Figure 1:
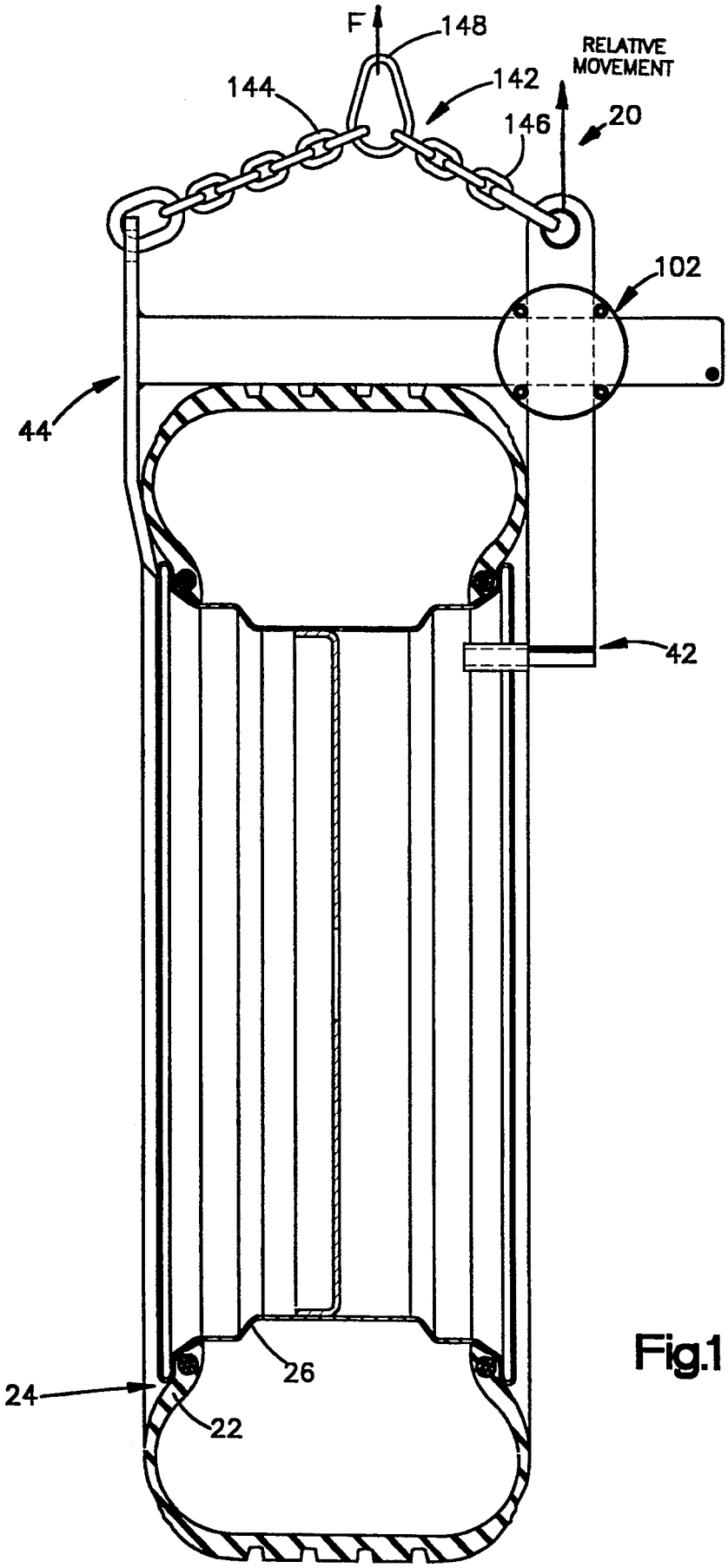
FIG. 1 is a view of the apparatus embodying the present invention in a position prior to lifting engagement with an article, such as a tire and rim assembly, which Is disposed in a substantially vertical orientation.

A tire lifting apparatus 20 is illustrated in FIG. 1 and is suitable for lifting a cylindrical or toroidal article. The article may be of any cylindrical or toroidal shape such as a tire 22 or assembly 24 of the tire 22 and rim 26 having a pair of axially outermost surfaces and a radially inward facing surface. The apparatus 20 may be used for a tire 22 alone which is uninflated or for an assembly 24 in which the tire may be partially or completely inflated or uninflated. The term "radial" or "radially" as used herein means in a direction inwardly or outwardly, or in a plane extending from, an axis about which a tire 22 or assembly 24 is rotatable about.

The term tire 22 as used herein is intended to mean the assembly 24 of the tire 22 and rim 26 as well as just the rim 26 or just the tire 22. The tire lifting apparatus 20 is particularly suitable for lifting a single tire oriented substantially vertically and maintaining the vertical orientation of the tire during the lifting movement. The words "vertical" or "vertically" is used herein to mean oriented to within plus or minus 15 degrees of a purely vertical or upright orientation. The apparatus 20 is also particularly suitable for removing an article or tire 22 which is on the end of a horizontal row of tires placed in side-by-side engagement and each tire oriented vertically.

The tire lifting apparatus 20 (FIG. 4) includes a pair of members 42,44. The member 42 includes an elongate bar portion 62. The bar portion 62 preferably has a rectangular cross-section (FIG. 5) and is preferably made from a metal material. A metal shaft 64 is (FIG. 4) fixedly attached to the side of the bar 62. Preferably the shaft 64 is welded to the side of the bar 62. The shaft 64 is disposed at the lower end of the bar 62, as viewed in FIG. 4, when the tire lifting apparatus 20 is supported from a mechanism (not shown) for use such as a hoist or other support means. A sleeve 66 may be inserted over the shaft 64. The sleeve 66 is made from a generally softer material than the shaft 64, such as plastic in order to prevent damaging the article to be lifted. The bar 62 includes an opening 68 therein at an axial end portion opposite the shaft 64. The opening 68 is for connection with an actuator mechanism, as will be described below.

The member 44 (FIG. 4) includes an elongate bar 82 preferably having a rectangular cross-section (FIG. 6) and made from a metal material. A finger 84 (FIGS. 4 and 6) is attached at one end of the bar 82. The finger 84 is preferably made from a steel material and has preferably a rectangular cross-section. The finger 84 has an opening 86 therethrough for receiving another portion of the actuation device as will be described below. At an opposite end portion 68 of the finger 84 opposite the opening 86, the finger is bent inwardly In a direction, as viewed in FIG. 4, to the side of the finger to which the bar 82 is attached and towards the member 42.

This inwardly bent portion 68 of the finger 84 is intended to engage a portion of a tire 22 or article to be lifted and which is disposed vertically. The inwardly bent portion 88 of the finger 84 is disposed downwardly, as viewed In FIG. 4, when the apparatus 20 is supported in a mechanism (not shown) such as a hoist or other support means. The inwardly bent portion 68 of the finger 84 is intended to also provide a relatively small amount of support to the article or tire 22 in the vertical direction. The inwardly bent portion 68 is primarily Intended to prevent the tire 22 or article from moving radially away from member 82.

Figure 6:
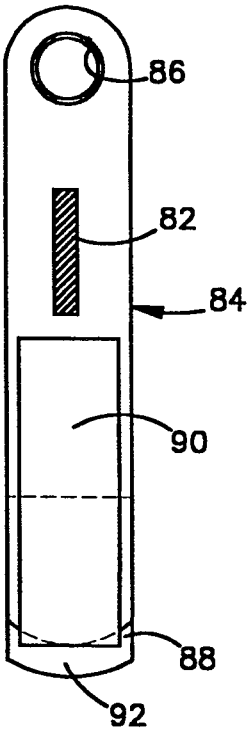
FIG. 6 is a partial cross-sectional view of the apparatus in FIG. 4, taken approximately along the line 6—6 in FIG. 4.

As viewed in FIG. 6, the portion 90 of the finger 84 intended to engage the sidewall portion of the tire 22 has friction enhancement material thereon in order to increase the frictional force between the finger and the tire or article in order to prevent slipping therebetween. The finger 84 also has a relatively thin and pointed lower end 92 to enable the finger to be readily forced between a pair of articles or tires 22 standing vertically in side-by-side engagement, or between an article and a surface it is resting against such as a wall. The end 92 of the finger 84 can be easily inserted there between because of its relatively thin dimension. Thus, relatively little horizontal movement of a tire 22 or article to be lifted occurs during an insertion of the end 92, therefore, less effort by an operator is required.

The bar 62 has an effective length L1 (FIG. 2) of sufficient dimension in order to span the largest section height H (FIG. 3) tire 22 anticipated to be lifted. The bar 82 has an effective length 12 (FIG. 2) of sufficient dimension to span the largest width W (FIG. 3) of a tire 22 anticipated to be lifted. The effective length L3 (FIG. 4) of the finger 84 for supporting a sidewall portion of the tire 22 is also of a sufficient dimension for the height H tire to be lifted and is proportionally matched to the effective length L1 to enable lifting the article or tire 22 and maintaining it in a substantially vertical orientation during handling of the article or tire.

Figure 4:
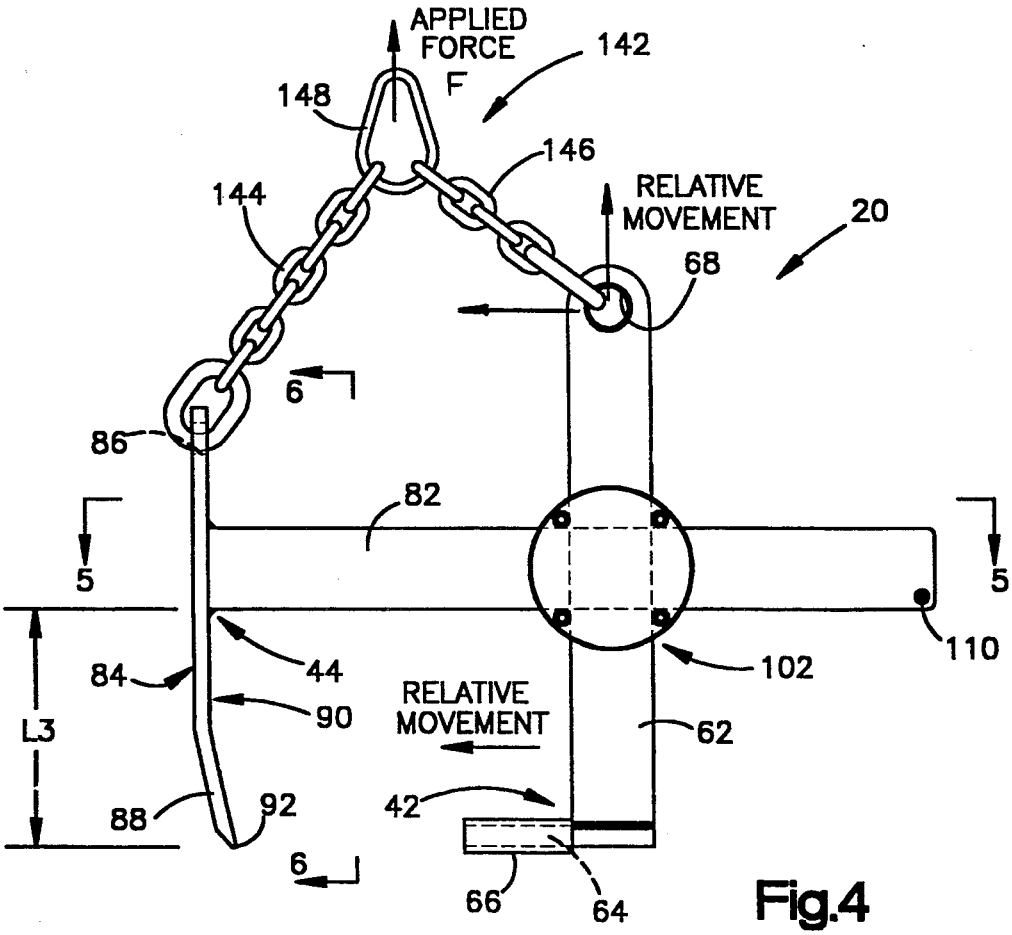
FIG. 4 is a view of Just the apparatus illustrated in FIG. 1 and illustrating relative movement of the members during actuation from the position illustrated in FIG. 2.
Figure 5:
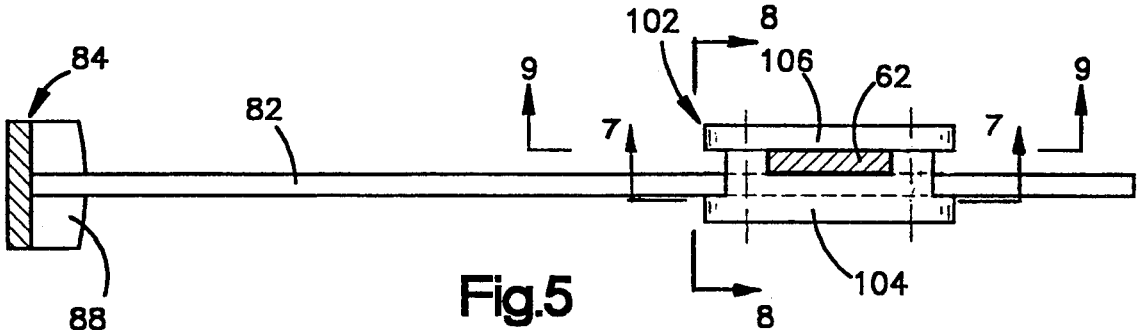
FIG. 5 is a partial cross-sectional view of the apparatus illustrated in FIG. 4, taken approximately along the line 5—5 in FIG. 4.
Figure 7:
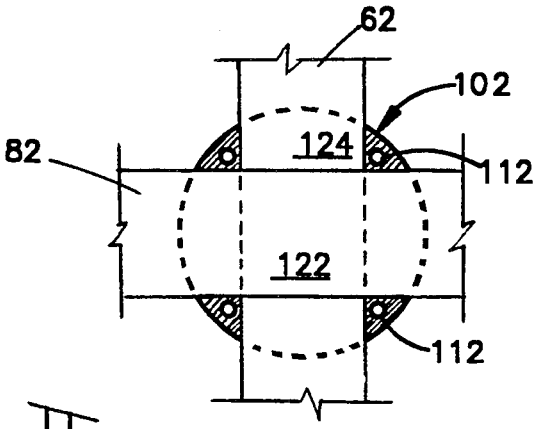
FIG. 7 is a view of one part of the clamp assembly of the apparatus illustrated in FIG. 5 taken approximately along line 7—7 in FIG. 5.
Figure 8:
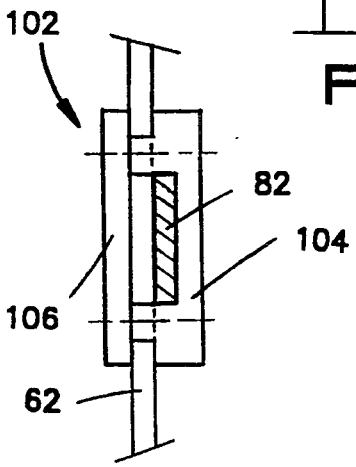
FIG. 8 is a cross-sectional view of the part of the clamp illustrated in FIG. 7, taken approximately along line 8—8 in FIG. 5.
Figure 9:
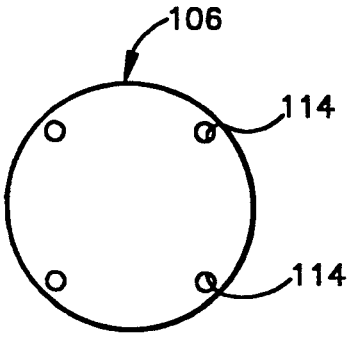
FIG. 9 is a view of another pan of the clamp assembly illustrated in FIG. 5, taken approximately along line 9—9 in FIG. 5.

The members 42,44 are supported for reciprocal and relative sliding movement by a clamp 102 (FIGS. 4 and 5). The clamp 102 has two pieces 104,106 (FIG. 5). The pieces are illustrated in detail in FIGS. 7, 8 and 9. The pieces 104, 106 are held together by appropriate fasteners such as bolts (not shown) extending through respective openings 112, 114 (FIGS. 7-9). One piece 104 (FIG. 7 and 8) of the clamp 102 has a pair of channels 122,124 for supporting a respective one of the bars 62,82. For example, bar 82 rests in channel 122 and bar 62 rests in channel 124. A second piece 106 (FIG. 9) is fastened to the first piece 104. The bars 62,82 are preferably placed in the clamp 102 before the pieces 104, 106 are fastened together. The clamp 102 supports the bars 62,82 of the members 42,44 for sliding movement relative to one another. However, the clamp 102 provides an additional feature in that the bars 62,82 are maintained in a substantially orthogonal relationship relative to one another either at rest or during movement when the bars 62,82 are properly installed in the clamp 102. A stop 110 may be attached to bar 82 and protrude from the bar to engage the clamp 102 and prevent the member 44 from detaching from the clamp.

The tire lifting apparatus 20 is actuated or moved by an actuator mechanism 142 from a first position, (illustrated in FIG. 2) spanning the tire 22, but not supporting or lifting the tire 22 to a second position, (illustrated in FIG. 3), in close engagement and surrounding the tire. In a preferred embodiment of the invention, the actuator mechanism 142 is a relatively simple linkage mechanism intended to be actuated by having legs 144,146 placed in tension. The actuator mechanism 142 includes a pair of legs 144,146 and a coupler 146. The legs 144,146 are intended to be placed in tension when the coupler 148 has a force F intended to move or displace it upwardly, as viewed in FIG. 4. The legs 144,146 are preferably made from a link chain. The leg 144 is preferably greater in length than the leg 146. The coupler 146 is preferably a pear shaped member which is larger than any link in the legs 144, 146.

One end of the leg 144 is operably connected to the member 44 at the opening 86 in the finger 84. The other end of the leg 144 is operably connected with the coupler 148. One end of the leg 146 is connected with the member 42 at the opening 68 in the bar 62. The other end of the leg 146 is operably connected with the coupler 148. It is assured that tension will always be applied to the member 146 during actuation of the actuator mechanism 142. This application of tension assures that the member 42 tends to be In a operatively supporting position and tending to maintain a position toward the second position (FIG. 3), being in complete contact with the tire 22 or assembly 24. Actuation of the actuator mechanism 142 means that tension is applied to the legs 144,146.

Figure 2:
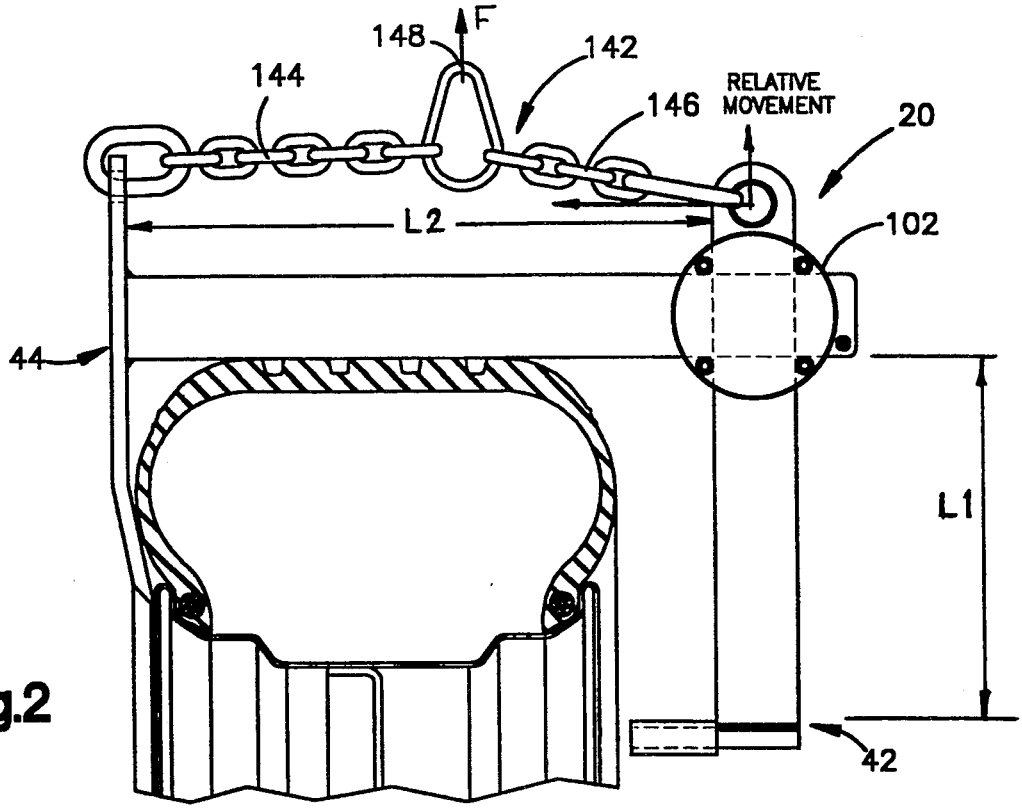
FIG. 2 is a view of the apparatus illustrated in FIG. 1 in an approximate position enabling the apparatus to span the width of the tire.

In operation, tire lifting apparatus 20 spans a tire 22, as illustrated in FIG. 2. The member 42 is moved to the right in the clamp 102 as far as possible relative to the member 44 so that the tire lifting apparatus 20 can be opened to a position wider than tire 22 in order to span it so that the finger 84 can be placed in a position, as illustrated in FIG. 2. At this point, the member 42 has no force applied to it and is approximately in the position incapable of lifting the assembly 24, as illustrated in FIG. 2. The tire 22 is acted upon by the engaging the finger 84 along the left most side of the tire so that the bar 82 rests upon the radial outermost surface of the tire 22.

Upon actuation of the actuator mechanism 142, a force F is applied upwardly to the coupler 146 by a hoist or other overhead support means. This force does several things. To the shorter leg 146 a large tensile force is applied which moves the member 42 largely to the left and somewhat upward as illustrated in FIG. 2. Upon further actuation of the actuator mechanism 142, more vertical force F and upward displacement is applied to the coupler 146. This causes the member 42 to move to the left so that the bar 62 now engages the right sidewall of the tire as illustrated in FIG. 1. The finger 84 already engages the radially innermost left sidewall of the tire 22 as the member 42 engages the right sidewall of the tire.

Figure 3:
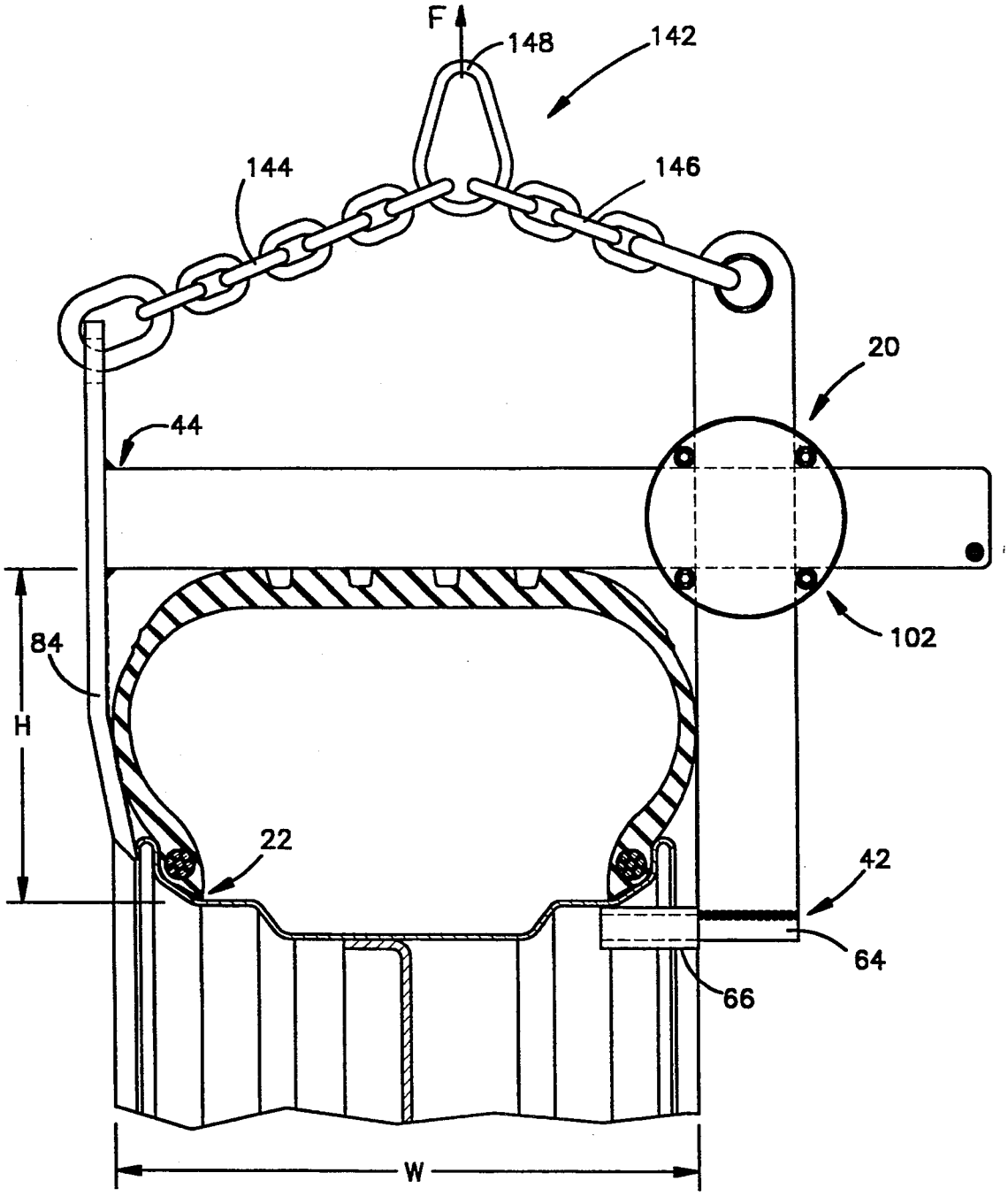
FIG. 3 is an enlarged view of the apparatus Illustrated in FIG. 1 moved to a position engaging a portion of the side of the tire which is disposed vertically and a portion of the wheel and tire assembly that is facing radially inward.

Further actuation now forces the member 42 upward as viewed in FIG. 1 towards the position illustrated in FIG. 3 since relative vertical and horizontal movement of the members 42,44 is blocked by the tire 22. Relative movement of members 42, 44 is also blocked by bars 62, 82 having a wedging action in the channels 122, 124 of the clamp 102. The shaft 64 and sleeve 66 engage the radially innermost facing portion of the tire 22. Upon further actuation of the actuator mechanism 142, tension forces will continue to be applied to both legs 144 and 146. When tension is applied to both legs 144, 146 such that the position of the coupler 148 is approximately vertically above the center of gravity of the tire 22, the tire 22 is lifted in essentially a vertical orientation and maintained in such orientation throughout the duration of handling the tire. A vertical orientation is maintained because the center of gravity of the tire 22 is located far below the location of coupler 148 and the vertical load support from the shaft 64. Gravity acts on the center of gravity of the tire 22 to keep the tire in a substantially vertical orientation while the finger 84 prevents the tire 22 from sliding off of the shaft 64. Most of the vertical load from the tire 22 is taken by the shaft 64.

The tire 22 can now be mounted on a vehicle or on a test apparatus. Keeping a force F supplied to the coupler 148 keeps the legs 144,146 in tension. This tension prevents the members 42,44 from moving from the second or lifting position towards the first position or non-lifting position. When the tire 22 is lifted into a desired position and supported, the force can be relaxed from the actuator mechanism 142 and the tire lifting apparatus removed from the tire.

The apparatus 20 has many important improvements and features. The apparatus 20 adapts itself to a wide range of tire 22 or assembly 24 sizes. It is operated the same way in each application without adjustments of the actuator mechanism 142, the two members 42, 44 or the clamp 102. It can be used with any convenient overhead hoist or lifting device. Various materials can also be used to obtain a light weight apparatus 20, including aluminum or a composite material. The apparatus should be economical to purchase and have a long service life without maintenance expenses. One apparatus can be used at various hoist locations as it is easily transportable.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, what is claimed is:

1. An apparatus for engaging an article for subsequent displacement of the article by displacing movement of the apparatus while the apparatus engages the article, comprising:

a first contact men%her positionable at a contact position for contacting a first portion of the article, the first contact men%her having means for receiving an adjusting force applied thereto such that the first contact member moves from a spaced apart position remote from its contact position to its contact position in response to the application of an adjusting force;

a second contact member positionable at a contact position for contacting the article at a second portion thereof spaced from the first portion of the article relative to a lateral axis, the first and second contact men%bets being effective, when both are deployed in their respective contact positions with the article, to retain the article therebetween during application of a displacement force to the apparatus;

means for guiding the first contact member to move laterally relatively toward the second contact member;

means for guiding the first contact member to move along a longitudinal axis forming a substantially perpendicular angle with the lateral axis; and means, movably interconnecting the lateral and longitudinal guiding means, for controlling both guiding means to automatically guide the first contact member from its spaced apart position to its contact position in response to the application of an adjusting force to the first contact member.

2. The apparatus set forth in claim 1 wherein said second contact member includes at least one finger for engaging a portion of the article which is disposed approximately vertically, and said first contact member includes a support for engaging a portion of the article which is disposed approximately horizontally.

3. The apparatus set forth in claim 2 further including friction enhancement means on a surface of said finger that is engageable with the approximately vertical portion of the article.

4. The apparatus set forth in claim 2 wherein said second contact member comprises an elongate bar having an effective length sufficient to span the largest width of an article anticipated to be lifted, the finger is attached to one end of said bar, said finger having a portion extending from said location of attachment to said bar in a direction toward the second one of said members.

5. The apparatus set forth in claim 2 wherein said second contact member comprises an elongate bar having an effective length sufficient to span the largest height of an article to be lifted, said support comprising a shaft extending transversely from said bar.

6. An apparatus for engaging a tire for subsequent displacement of the tire by displacing movement of the apparatus while the apparatus engages the tire, comprising:

a first contact member positionable at a contact position for contacting a first portion of the tire, the first contact member having means for receiving an adjusting force applied thereto such that the first contact men%her moves from a spaced apart position remote from its contact position to its contact position in response to the application of an adjusting force;

a second contact men%her positionable at a contact position for contacting the tire at a second portion thereof spaced from the first portion of the article relative to a lateral axis, the first and second contact members being effective, when both are deployed in their respective contact positions with the tire, to retain the tire therebetween during application of a displacement force to the apparatus;

means for guiding the first contact member to move laterally relatively toward the second contact member;

means for guiding the first contact member to move along a longitudinal axis forming a substantially perpendicular angle with the lateral axis; and means, movably interconnecting the lateral and longitudinal guiding means, for controlling both guiding means to automatically guide the first contact member from its spaced apart position to its contact position in response to the application of an adjusting force to the first contact member.

7. The apparatus set forth in claim 6 wherein said second contact member includes at least one finger for engaging a portion of the tire which is disposed approximately vertically, and said first contact member includes a support for engaging a portion of the tire which is disposed approximately horizontally.

8. The apparatus set forth in claim 7 further including friction enhancement means on a surface of said finger that is engaging with the portion of the tire which is disposed approximately vertically.

9. The apparatus set forth in claim 7 wherein said first contact member comprises an elongate bar having an effective length sufficient to span the largest height tire to be lifted, said support comprising a shaft extending transversely from said bar.

* * * * *